US006418910B1

(12) United States Patent
Nally et al.

(10) Patent No.: US 6,418,910 B1
(45) Date of Patent: Jul. 16, 2002

(54) RAIL GEOMETRY FOR MINIMIZATION OF FLUID PRESSURE PULSATIONS

(75) Inventors: Debora Nally, Williamsburg; Stephen C. Bugos, Newport News, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/970,676

(22) Filed: Oct. 5, 2001

(51) Int. Cl.[7] ..... F02M 37/04
(52) U.S. Cl. ..... 123/456
(58) Field of Search ..... 123/456, 468

(56) References Cited

U.S. PATENT DOCUMENTS 5,575,262 A * 11/1996 Rohde ..... 123/456
5,803,051 A * 9/1998 Stehr ..... 123/456
5,845,621 A * 12/1998 Robinson et al. ..... 123/456
6,205,979 B1 * 3/2001 Sims, Jr. ..... 123/456
6,314,942 B1 * 11/2001 Kilgore et al. ..... 123/467
2001/0037795 A1 * 11/2001 Stieler ..... 123/456

* cited by examiner

*Primary Examiner*—Thomas N. Moulis

(57) ABSTRACT

A fuel rail for a non-return fuel injection system and a method of breaking-up pressure pulsations in the fuel rail. The fuel rail comprises an inlet, at least one first outlet, and a first tube providing fluid communication between the inlet and the at least one outlet. The inlet is adapted for fluid communication with a source of pressurized fuel. Each at least one first outlet is adapted for fluid communication with a respective fuel injector. The first tube extends along a first axis and includes a first portion and a second portion. The first portion extends a first length along the first axis and has a first cross-sectional shape transverse to the first axis. The second portion extends a second length along the first axis and has a second cross-sectional shape transverse to the first axis. The second cross-sectional shape has a first indentation toward the first axis, and the first indentation disrupts pressure pulsations propagating through the first tube.

13 Claims, 2 Drawing Sheets

RAIL GEOMETRY FOR MINIMIZATION OF FLUID PRESSURE PULSATIONS

FIELD OF THE INVENTION

The present disclosure is directed to the configuration of a fuel rail for a fuel injection system of an internal combustion engine. In particular, the present disclosure is directed to an improved fuel rail geometry that minimizes fluid pressure pulsations within the fuel rail system.

BACKGROUND OF THE INVENTION

It is believed that it is desirable for fuel injection systems to insure that the fuel is evenly distributed to each cylinder of a multi-cylinder engine. It is believed that a fuel rail distributes to plural fuel injectors the fuel that is supplied from a fuel tank. It is believed that these fuel injectors can be operated in response to electrical signals from an engine control unit, and that the fuel required for combustion is sprayed out of the injector, into either an intake manifold or directly into a combustion cylinder.

It is believed that an adequate supply of fuel for all the injectors can be provided via a fuel rail having a large enough capacity to ensure that sufficient fuel is available at all times to the fuel injectors. It is further believed that a so-called "return system" feeds fuel in excess of that required by the fuel injectors back to the fuel tank via a return line. It is believed that the excess fluid is heated as a result of being circulated through the engine compartment, and that this heating can adversely affect the control of emissions from the fuel system.

It is believed that adequate fuel pressure for each fuel injector can be provided with a pressure-regulating device connected downstream of the fuel rail. When fuel pressure in the fuel rail is above a certain set point, it is believed that the pressure-regulating device opens to allow the excess fuel to be returned to the fuel tank via the return line, thus controlling pressure in the rail. When fuel pressure in the fuel rail is below the set point, it is believed that the pressure-regulating device is closed to allow pressure to build up in the fuel rail. It is believed that some pressure-regulating devices are operated using a vacuum bias tube that is coupled to the engine intake manifold.

It is believed that there are a number of deficiencies and disadvantages that are associated with know "return" fuel systems, which has led to the development of a "non-return" fuel system. It is believed that non-return fuel systems include a pressure-regulating device that is placed closer to the fuel tank, and that a return line from the fuel rail to the fuel tank is eliminated. Is believed that by virtue of the pressure being regulated upstream of the fuel rail, there is no excess pressure/fuel that is returned to the fuel tank after having been circulated through the engine compartment. It is believed that "non-return" systems provide improved emissions control and reduced cost. However, it is believed that "non-return" systems experience fuel pressure pulsations in the fuel rail.

It is believed that there is a need to provide a non-return fuel system that minimizes the fluid pressure pulsations in the fuel rail.

SUMMARY OF THE INVENTION

The present invention provides a fuel rail for a non-return fuel injection system. The system includes a source of pressurized fuel and at least one fuel injector. The fuel rail comprises an inlet, at least one first outlet, and at least one tube providing fluid communication between the inlet and the at least one outlet. The inlet is adapted for fluid communication with the source of pressurized fuel. The at least one first outlet is adapted for fluid communication with a respective fuel injector. The at least one tube extends along a first axis and includes a first portion and a second portion. The first portion extends a first length along the first axis and has a first cross-sectional shape transverse to the first axis. The second portion extends a second length along the first axis and has a second cross-sectional shape transverse to the first axis. The second cross-sectional shape has a first indentation toward the first axis, and the first indentation disrupts pressure pulsations propagating through the at least one tube.

The present invention also provides a method of of reducing pressure pulsations in a non-return fuel injection system. The pressure pulsations arise as at least one fuel injector discharges fuel and a source of pressurized fuel replenishes the fuel available to the at least one fuel injector. The method comprises providing a fuel rail and indenting the fuel rail to disrupt the pressure pulsations. The fuel rail establishes fluid communication between the source of pressurized fuel and the at least one fuel injector. The fuel rail extends along an axis. The indenting includes providing the fuel rail with different transverse cross-sections along the axis.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
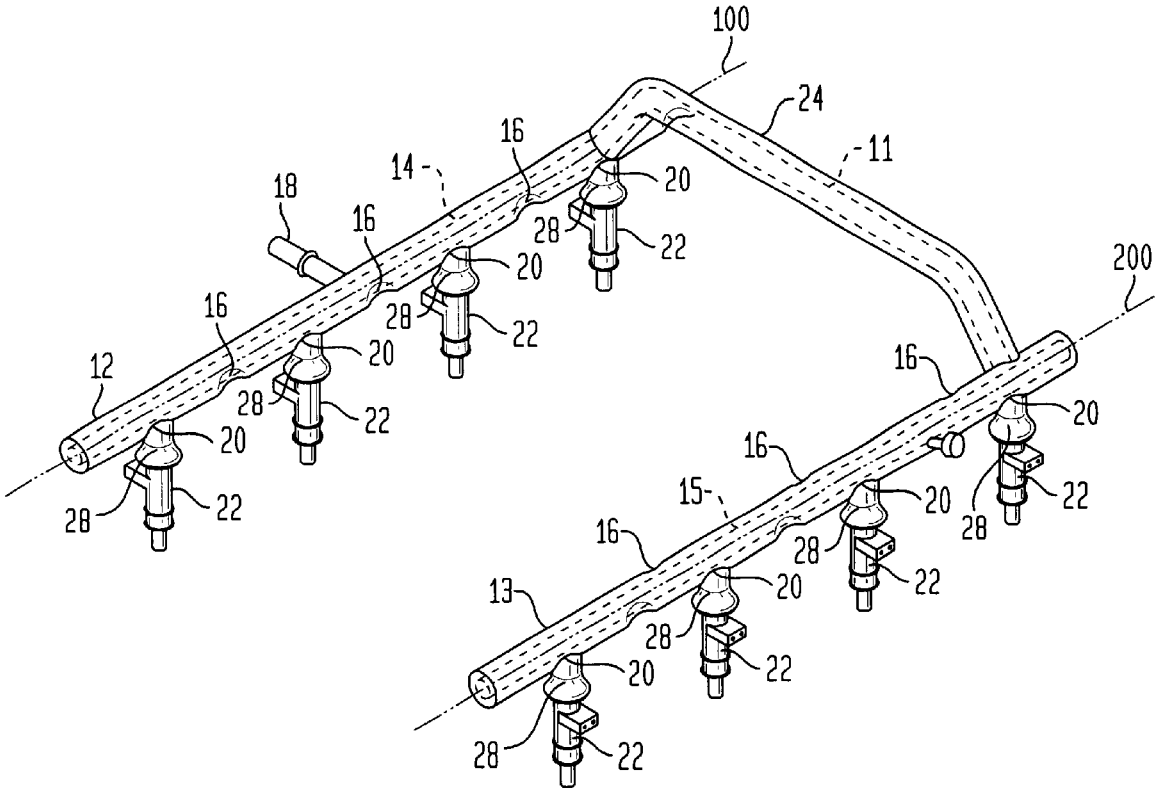
FIG. 1 is perspective view of the fuel rail according to a preferred embodiment.
Figure 2:
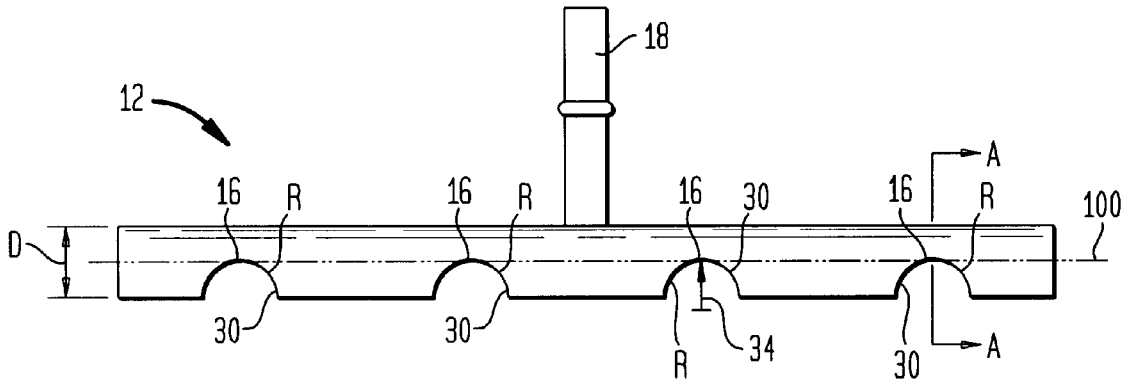
FIG. 2 is a plan view of a longitudinal member showing the indentation of the fuel rail.
Figure 3:
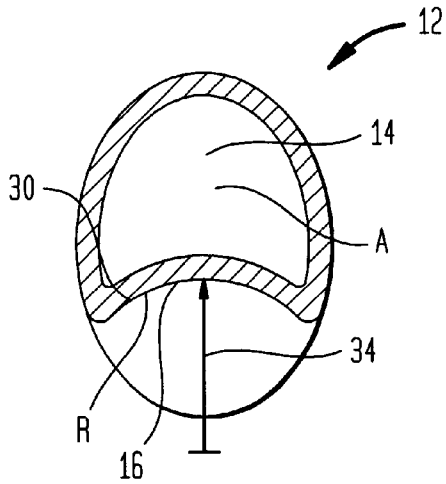
FIG. 3 is the cross-sectional view taken along line III—III in FIG. 2.

Referring to the FIGS. 1–3, there is shown a fuel rail 10 for a non-return fuel injection system according to a preferred embodiment. As used herein, like numerals indicate like elements throughout the description. The rail 10 includes a first longitudinal tubular member 12 that extends along a first axis 100. As it is used herein, the term "axis" may refer to a collection points that are linear, arcuate, or a combination of linear and arcuate segments. The rail 10 can also include a second longitudinal tubular member 13 that defines a second axis 200. The rail 10 additionally includes an intermediate tubular member 24 that connects the first longitudinal member 12 and the second longitudinal member 13. The intermediate member 24 is generally a rigid member. However, those skilled in the art should recognize that the intermediate member 24 could be constructed out of a flexible material as well. The first longitudinal member 12 defines a passageway 14 that extends along the axis 100. The second longitudinal member 13 defines a passageway 15 that extends along the axis 200. The first longitudinal member 12 and the second longitudinal member 13 include first and third portions, respectively, which have a substantially constant cross-sections, and include second and fourth portions, respectively, that have at least one indentation 16.

The connecting intermediate member 24 comprises a passageway 11 that is in fluid communication with the first longitudinal member 12 and second longitudinal member 13.

Referring particularly to FIG. 2, there is shown the first longitudinal member 12 according to the preferred embodiment. The at least one indentation 16 of the first longitudinal member 12 comprises an arcuate surface 30. The arcuate surface 30 has a radius of curvature R with respect to a line 34. The line 34 is spaced radially and is oriented perpendicular to the axis 100. The geometry of the arrangement of the at least one indentation 16 on the second longitudinal member 13 is the same as the arrangement off the first longitudinal member 13. It should be recognized by those skilled in the art that the shape of the surface of the at least one indentation 16 may be other than arcuate, e.g., it may be spherical, etc. It should also be recognized by those skilled in the art that the radius R might be varied in length depending on application. The longitudinal member 12, where it does not have an indentation 16, may have a circular cross-section having a diameter D. It should be recognized by those skilled in the art that the diameter D may be varied, and that the longitudinal member 12 may have a non-circular cross-section, depending on application.

The longitudinal member 12 can comprise a plurality of indentations 16 (four are illustrated). The plurality of indentations 16 project toward the axis 100 of the first longitudinal member 12, and project toward the axis 200 of the second longitudinal member 13. In the preferred embodiment of the rail 10, the plurality of indentations 16 are spaced equidistant along the axis 100 of the first longitudinal member 12 and are spaced equidistant along the axis 200 of the second longitudinal member 13. It should be recognized by those skilled in the art that the plurality of indentations 16 are not required to be spaced in an equidistant pattern.

The rail 10 further includes a single inlet port 18 for fuel from source of pressurized fuel (not shown). The single port 18 is disposed on the member 12 and is in communication with the passageway 14. The rail 10 additionally includes at least one outlet port 20 (four are shown on each of longitudinal members 12 and 13). Each one of the at least one outlet ports 20 can provide fluid communication between the rail 10 and a respective fuel injector 22. The plurality of outlet ports 20 are in communication with the passageways 14 and 15 of the members 12 and 13 respectively. It should be recognized by those skilled in the art that the number and or the location of the plurality of outlet ports 20 and fuel injectors 22 can vary depending on the design application of the rail 10.

Each of the outlet ports 20 can comprises a corresponding injector cup 28. Each injector cup 28 facilitates joining a respective outlet port 20 with its corresponding fuel injector 22.

According to the preferred embodiment, there is a method of reducing pressure pulsations in the passageway 14. The pressure pulsations arise as each fuel injector 22 discharges fuel and the source of pressurized fuel replenishes the fuel available to the fuel injectors 22. The method comprises providing the member 12 that extends along the axis 100 between the single inlet port 18 and the outlet ports 20. The single inlet port 18 provides fluid communication with the source of pressurized fuel (not shown). And the fuel injectors 22 operate in open and closed configurations to discharge precise amounts of fuel.

Referring particularly to FIG. 3, there is shown a cross sectional view of the preferred embodiment of the longitudinal member 12. The method further includes forming at least one indentation 16 in the longitudinal member 12 to break-up pressure pulsations in the pressurized fuel in the passageway 14. That is to say, the at least one indentation 16 obstructs the propagation of pressure pulsations in the passageway 14 as the solenoid actuated regulated fluid port 20 discharges fuel and the source of pressurized fuel (not shown) replenishes the fuel in the passageway 14.

The method also includes modeling the characteristics of fluid flow between the single entry port 18 and solenoid actuated fluid ports 20. The modeling characteristics comprise obtaining minimum and maximum fluid flows through the solenoid actuated fluid ports 20. The percent difference between the minimum and maximum fluid flow is called the percent delta. The percent delta represents the amount of misdistribution of fluid flow between the solenoid actuated fluid ports 20. The indentations 16 are positioned on the longitudinal member 12 in response to the modeling. An ideal modeled rail 10 would have zero percent delta and thus zero misdistribution.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel rail for a non-return fuel injection system, the system including a source of pressurized fuel and at least one fuel injector, the fuel rail comprising:

an inlet adapted for fluid communication with the source of pressurized fuel;

at least one first outlet adapted for fluid communication with a respective fuel injector; and at least one tube providing fluid communication between the inlet and the at least one outlet, the at least one tube extending along a first axis and including:

a first portion extending a first length along the first axis and having a first cross-sectional shape transverse to the first axis; and a second portion extending a second length along the first axis and having a second cross-sectional shape transverse to the first axis, the second cross-sectional shape having a first indentation toward the first axis, the first indentation disrupting pressure pulsations propagating through the at least one tube.

2. The fuel rail according to claim 1, wherein the first cross-sectional shape is substantially constant along the first length.

3. The fuel rail according to claim 2, wherein the second cross-sectional shape varies along the second length.

4. The fuel rail according to claim 1, wherein the at least one tube comprises a plurality of the second portions.

5. The fuel rail according to claim 4, wherein the at least one tube comprises a plurality of the first portions, and the first and second portions alternate along the first axis.

6. The fuel rail according to claim 1, wherein the at least one tube comprises a plurality of outlets spaced along the axis, and the first indentation is positioned along the first axis between an adjacent pair of the plurality of outlets.

7. The fuel rail according to claim 1, wherein the outlet extends along a first radius of the first axis, the indentation is generally symmetrical about a second radius of the first axis, and the first and second radii are generally perpendicular with respect to each other and to the first axis.

8. The fuel rail according to claim 1, wherein the at least one tube comprises a plurality of the first indentations, each of the plurality of the first indentions is generally symmetrical about a respective radius, and the radii are angularly oriented with respect to one another around the first axis.

9. The fuel rail according to claim 1, wherein the first portion comprises a first diameter with respect to the first axis, the second portion comprises a second diameter with respect to the first axis, and the second diameter is less than the first diameter.

10. The fuel rail according to claim 1, wherein the indentation comprises an arcuate wall intersecting with the at least one tube, the arcuate wall being centered around an imaginary axis spaced from and perpendicular to the first axis.

11. The fuel rail according to claim 1, wherein the at least one tube comprises an additional tube extending along a second axis spaced from the first axis, the additional tube including:

a third portion extending a third length along the second axis and having a third cross-sectional shape transverse to the second axis;

a fourth portion extending a fourth length along the second axis and having a fourth cross-sectional shape transverse to the second axis, the fourth cross-sectional shape having a second indentation toward the second axis, the second indentation disrupting pressure pulsations propagating through the additional tube; and at least one second outlet adapted for fluid communication with a respective fuel injector; and a connecting tube providing fluid communication between the at least one tube and the additional tube.

12. A method of reducing pressure pulsations in a non-return fuel injection system, and the pressure pulsations arising as at least one fuel injector discharges fuel and a source of pressurized fuel replenishes the fuel available to the at least one fuel injector, the method comprising:

providing a fuel rail establishing fluid communication between the source of pressurized fuel and the at least one fuel injector, the fuel rail extending along an axis; and indenting the fuel rail to disrupt the pressure pulsations, the indenting including providing the fuel rail with different transverse cross-sections along the axis.

13. The method according to claim 12, further comprising:

tuning the indenting to disrupt different pressure pulsations arising due to different fuel discharge volumes from the at least one fuel injector.

* * * * *